US011867472B2

(12) United States Patent
Army et al.

(10) Patent No.: US 11,867,472 B2
(45) Date of Patent: Jan. 9, 2024

(54) HEATED HEADER FOR SUBFREEZING HEAT EXCHANGER

(71) Applicant: Hamilton Sundstrand Corporation, Charlotte, NC (US)

(72) Inventors: Donald Army, Enfield, CT (US); Eric J. Welch, Feeding Hills, MA (US); Patrick McCord, Norwich, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 166 days.

(21) Appl. No.: 17/246,587

(22) Filed: Apr. 30, 2021

(65) Prior Publication Data

US 2022/0349660 A1 Nov. 3, 2022

(51) Int. Cl.
*F28F 9/02* (2006.01)

(52) U.S. Cl.
CPC ..... *F28F 9/02* (2013.01)

(58) Field of Classification Search
CPC ..... F28F 9/02; F28F 9/0234; F28F 9/0224; F28F 9/0202; F28F 2009/0295; F28F 9/0243; F28F 2009/0287; F28F 2009/0285; F01N 13/02
See application file for complete search history.

(56) References Cited

U.S. PATENT DOCUMENTS 1,286,764 A * 12/1918 Phillippi ..... F25B 39/04 165/110
4,246,963 A 1/1981 Anderson
4,685,292 A * 8/1987 Brigham ..... F28F 9/0234 60/320
4,834,171 A 5/1989 Larrabee et al.
5,823,250 A * 10/1998 Barten ..... F28F 9/0234 165/169
6,286,587 B1 9/2001 Landry
7,121,325 B2 10/2006 Krueger et al.
8,851,156 B2 10/2014 Semmes
10,107,554 B2 10/2018 Delugan
2009/0188247 A1 * 7/2009 Phillips, Jr. ..... F01N 13/102 60/323
2018/0094859 A1 * 4/2018 Bardeleben ..... F28D 9/0043

FOREIGN PATENT DOCUMENTS

JP 2000356482 A 12/2000
JP 2009264719 A * 11/2009
WO 2014064079 A1 5/2014

OTHER PUBLICATIONS

Extended European Search Report for EP Application No. 22171107.0, dated Sep. 7, 2022, pp. 7.

* cited by examiner

*Primary Examiner* — Harry E Arant
(74) *Attorney, Agent, or Firm* — Kinney & Lange, P. A.

(57) ABSTRACT

A heat exchanger header includes a first inlet, a first passageway that fluidically connects the first inlet to a first outlet, a second inlet, and a second passageway. The second passageway fluidically connects the second inlet to a second outlet. The first inlet, the first passageway, and the first outlet are fluidically isolated from the second inlet, the second passageway, and the second outlet.

17 Claims, 7 Drawing Sheets

HEATED HEADER FOR SUBFREEZING HEAT EXCHANGER

BACKGROUND

The present disclosure relates to heat exchangers, and in particular to heat exchanger headers.

Heat exchangers are often used to transfer heat between two fluids. For example, on aircraft, heat exchangers are used for transferring heat between a relatively hot air source, e.g., bleed air from a gas turbine engine, and a relatively cool air source, e.g., ram air. Ice accretion affects the performance of such heat exchangers. For example, ice accretion in a header of a heat exchanger can result in an increased pressure drop and decreased performance across the heat exchanger. Consequently, ice accretion must be prevented.

SUMMARY

In one example, a heat exchanger header includes a first inlet, a first passageway that fluidically connects the first inlet to a first outlet, a second inlet, and a second passageway. The second passageway fluidically connects the second inlet to a second outlet. The first inlet, the first passageway, and the first outlet are fluidically isolated from the second inlet, the second passageway, and the second outlet.

In another example, a heat exchanger header includes a body with an outer surface and an inner surface. The inner surface defines a plenum and a first outlet fluidically connected with the plenum. The heat exchanger header also includes a first inlet extending through the body and fluidically connected with the plenum. A heating fluid channel is formed in the body between the outer surface and the inner surface and extends from a second inlet to a second outlet. The heating fluid channel is fluidically isolated from the plenum, and an insulation layer covers the outer surface of the body.

In another example, a heat exchanger includes a core with a first layer having at least one passageway that extends in a first direction from an inlet to an outlet. The core also includes a second layer contiguous with the first layer, the second layer having at least one passageway extending in a second direction. The heat exchanger also includes a header that includes a body with an outer surface and an inner surface. The inner surface defines a plenum and a first outlet that fluidically connects the plenum and the inlet of the first layer of the core. The header also includes a first inlet extending through the body and fluidically connected with the plenum. A heating fluid channel is formed in the body between the outer surface and the inner surface and extends from a second inlet to a second outlet. The heating fluid channel is fluidically isolated from the plenum. The header also includes an insulation layer covering the outer surface of the body.

Figure 1A:
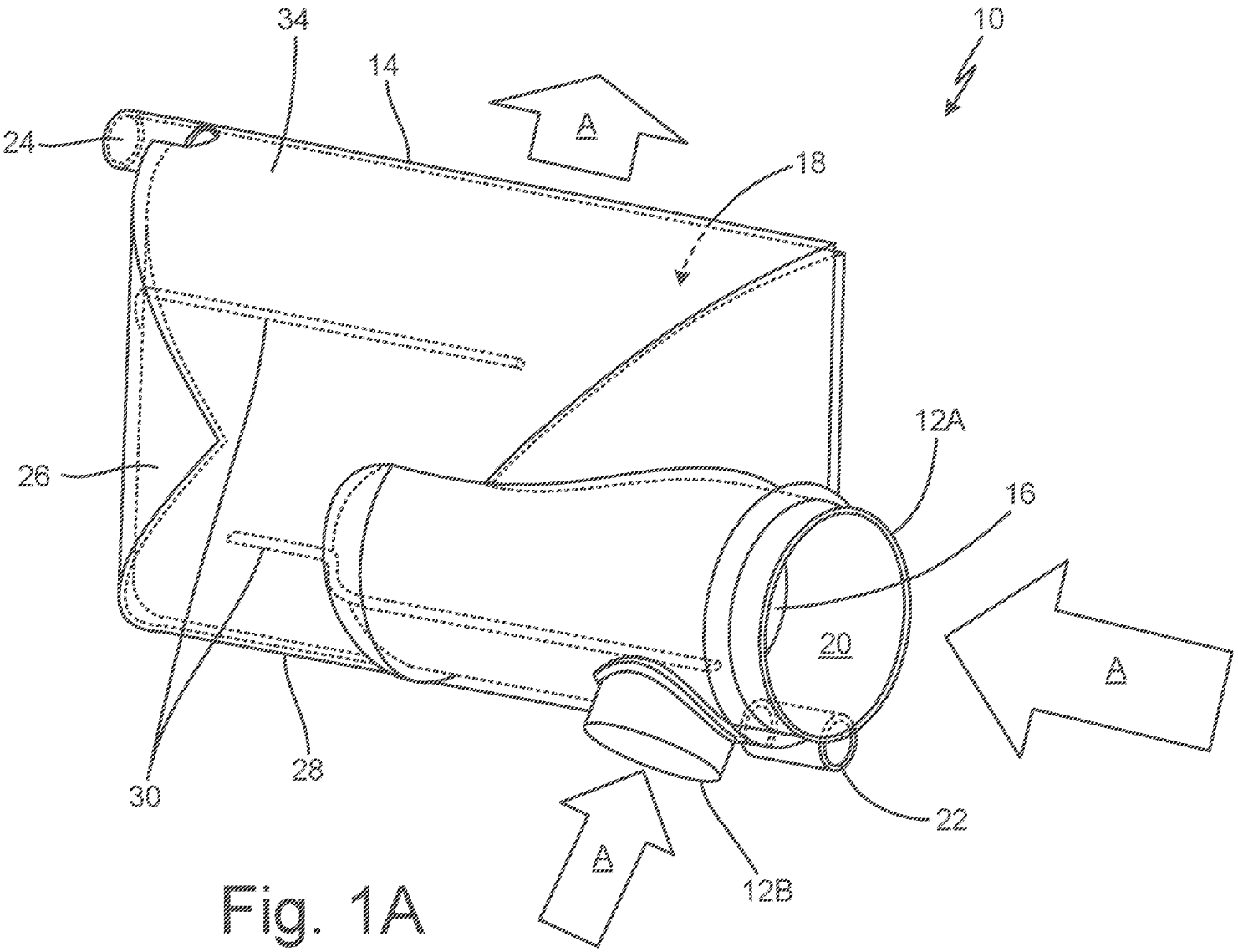
FIG. 1A is a perspective view of a header for a heat exchanger.

While the above-identified figures set forth one or more embodiments of the present disclosure, other embodiments are also contemplated, as noted in the discussion. In all cases, this disclosure presents embodiments by way of representation and not limitation. It should be understood that numerous other modifications and embodiments can be devised by those skilled in the art, which fall within the scope and spirit of the principles of the disclosure. The figures may not be drawn to scale, and applications and embodiments of the present disclosure may include features and components not specifically shown in the drawings.

DETAILED DESCRIPTION

In the present disclosure, a heat exchanger includes a header with a first passageway and a second passageway. A first wall separates and fluidically isolates the first passageway from the second passageway. The first passageway directs fluid from an aircraft system, e.g., a turbine, to a core of the heat exchanger. The second passageway directs a heating fluid through a heating channel. The heating channel heats the first wall, limiting or preventing ice accretion on the first wall within the first passageway. The header will be discussed below with reference to FIGS. 1A-5B.

Figure 1B:
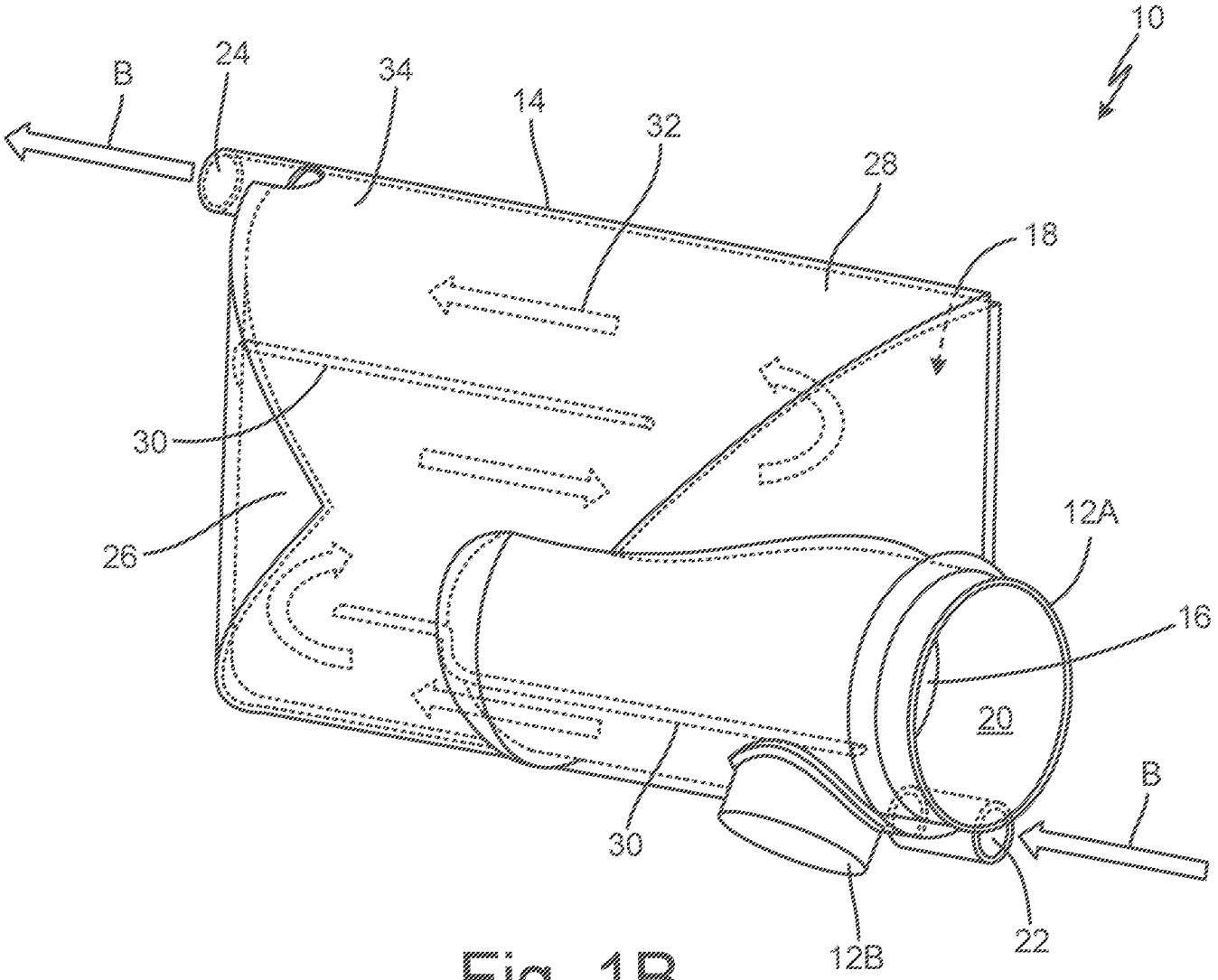
FIG. 1B is a perspective view of the header showing a heating channel.

FIGS. 1A and 1B will be discussed concurrently. FIG. 1A is a perspective view of header 10 showing airflow A through header 10. FIG. 1B is a perspective view of header 10 showing flow B through header 10. Header 10 includes first inlets (12A and 12B, hereinafter referred to in combination as first inlets 12), first outlet 14, first passageway 16, first wall 18, inner surface 20, second inlet 22, second outlet 24, second passageway 26, second wall 28, at least one or more partitions (partitions) 30, heating fluid channel (heating channel) 32, and outer surface 34.

First passageway 16 fluidically connects first inlets 12 to first outlet 14. First wall 18 and second wall 28 together form a body of header 10. First wall 18 defines inner surface 20. Inner surface 20 defines plenum 38 (shown in FIGS. 2 and 4) and first outlet 14. Plenum 38 is adjacent to outlet 14. First inlets 12 extend through both first wall 18 and second wall 28. First inlet 12A connects to a cold air system of an aircraft, e.g., a turbine, and directs airflow A into first passageway 16. First inlet 12B connects to a warmer air source, e.g., a turbine bypass, which provides airflow A of a higher temperature that can be used to regulate the air temperature within first passageway 16. As shown by airflow A, first wall 18 redirects airflow A into first inlets 12 and turns airflow A towards outlet 14. Aiflow A expands in plenum 38 (shown in FIGS. 2 and 4) before reaching outlet 14. Lastly, airflow A exits header 10 through outlet 14. The edges of outlet 14 can be tapered. The tapered edge of outlet 14 enables a single combined thickness of first wall 18 and second wall 28 such that the header to be, e.g., butt or fillet, welded to a core of the heat exchanger. This single combined thickness provides a preferred structural joint between header 10 and the core of the heat exchanger.

Second wall 28 is attached to first wall 18 opposite first passageway 16. As shown in FIGS. 1A and 1B, second wall 28 defines outer surface 34 of header 10. Second passageway 26 is between first wall 18 and second wall 28. Second passageway 26 fluidically connects second inlet 22 and second outlet 24. Second passageway 26 is fluidically isolated from first passageway 16. Second inlet 22 extends only through second wall 28 and does not penetrate first wall 18. Second inlet 22 is connected to a heating fluid source and directs a heating fluid into second passageway 26. Partitions 30 extend from first wall 18 to second wall 28. Partitions 30 help support header 10 by providing stiffness and structure between first wall 18 and second wall 28. Partitions 30 create heating channel 32 within second passageway 26. Heating channel 32 defines the path for fluid flow B of the heating fluid within second passageway 26. As shown in FIGS. 1A and 1B, second inlet 22 is formed near a bottom of header 10, and second outlet 24 is formed near a top of header 10. Having second inlet 22 lower gravitationally from second outlet 24 helps remove air from the heating fluid as the heating fluid flows through heating channel 32. As heating channel 32 is filled with the heating fluid the heating fluid displaces air within second passageway 26. The displaced air will be carried to the highest elevation where a bleeder plug can be opened to let the displaced air escape from heating channel 32.

In the example shown in FIGS. 1A and 1B partitions 30 are configured so that flow B within heating channel 32 is a three-pass route from second inlet 22 to second outlet 24. In another example, a plurality of partitions 30 can be located within second passageway 26 to alter flow B within heating channel 32 to match heating demands required to prevent ice accretion on header 10. Partitions 30 can be configured to change flow B within heating channel 32 on first wall 18. For example, more partitions 30 can be installed within second passageway 26 to change flow B within heating channel 32. The changes of flow path B can change the temperature gradient between heating channel 32 and first wall 18. More specifically, partitions 30 can be installed within second passageway 26 so that heating channel 32 is concentrated on the coldest portions, e.g., inlet 12 and first passageway 16, of header 10. The heating of first wall 18 prevents ice accretion on inner surface 20 within first passageway 16. The heating fluid can be ethylene glycol, polyalphaolefin (PAO), and/or any other coolant used in engines.

Figure 2:
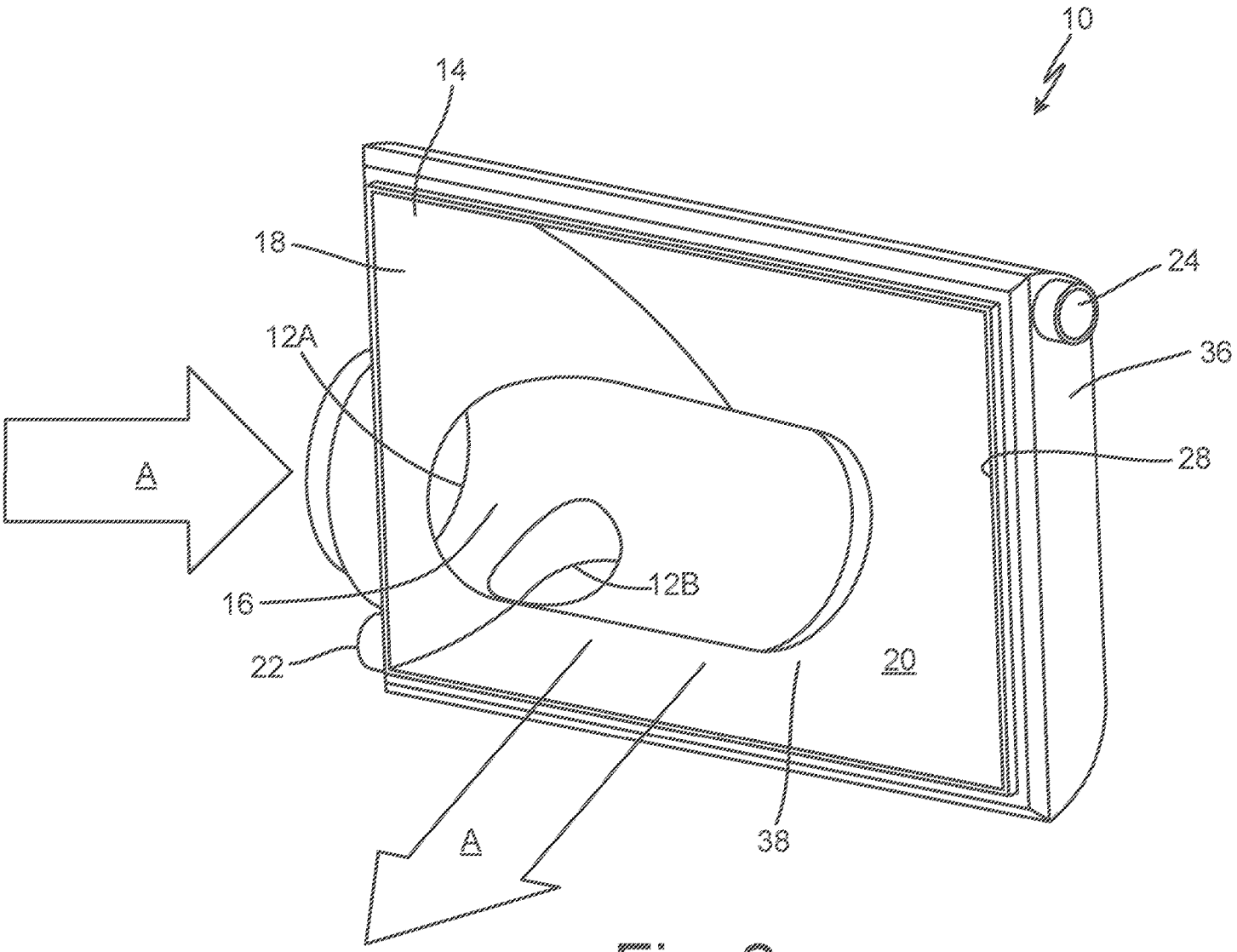
FIG. 2 is a perspective view of the inside of the header.

FIG. 2 is a perspective view of header 10 showing an interior of header 10 which includes plenum 38. In the example of FIG. 2, header 10 further includes insulation layer 36. Insulation layer 36 is attached to second wall 28 opposite of first wall 18 and covers outer surface 34. Insulation layer 36 shields header 10 from the surrounding environment. Insulation layer 36 helps better control the temperature of the heating fluid in heating channel 32 (shown in FIG. 1B) and the temperature of the airflow in plenum 38 and the rest of first passageway 16. Insulation layer 36 can be made from rockwool, fiberglass, kaowool, or any other insulation suitable for minimizing heat transfer from header 10 to the surrounding environment. Plenum 38 is formed by inner surface 20 of first wall 18. First wall 18 fluidically isolates plenum 38 and heating channel 32. Plenum 38 is the widening of first passageway 16 after first passageway 16 turns the airflow from inlets 12 towards outlet 14. Plenum 38 helps distribute the airflow within first passageway 16 toward outlet 14. When header 10 is connected to a heat exchanger core, the airflow distribution from plenum 38 ensures that a consistent amount of air enters each layer of the heat exchanger core when the airflow leaves outlet 14.

Figure 3:
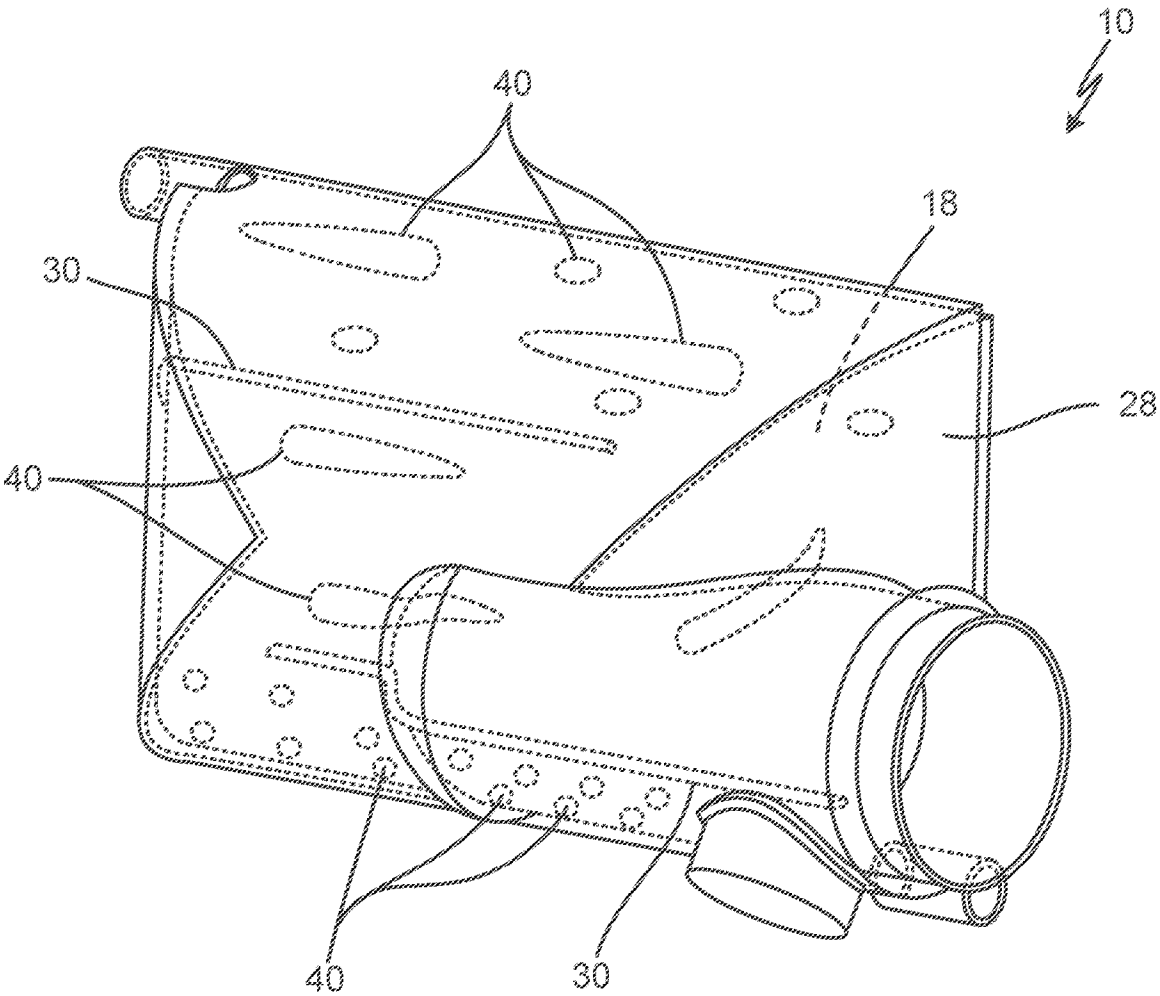
FIG. 3 is a perspective view of a header with supports within the heating channel.

FIG. 3 is a perspective view of header 10 with supports 40. Header 10 includes supports 40. Supports 40 also extend from first wall 18 to second wall 28 within second passageway 26. Supports 40 improve the stiffness of header 10 and provide support between first wall 18 and second wall 28. Supports 40 also improve the heat transfer between heating channel 32 and first wall 18. In the example shown in FIG. 3, supports 40 include both columns and fins. In another example, supports 40 can be columns, fins, posts, H-beams, I-beams, chevron-shaped and/or any other shape used to enhance heat transfer, flow distribution, or add structure integrity to header 10.

Figure 4:
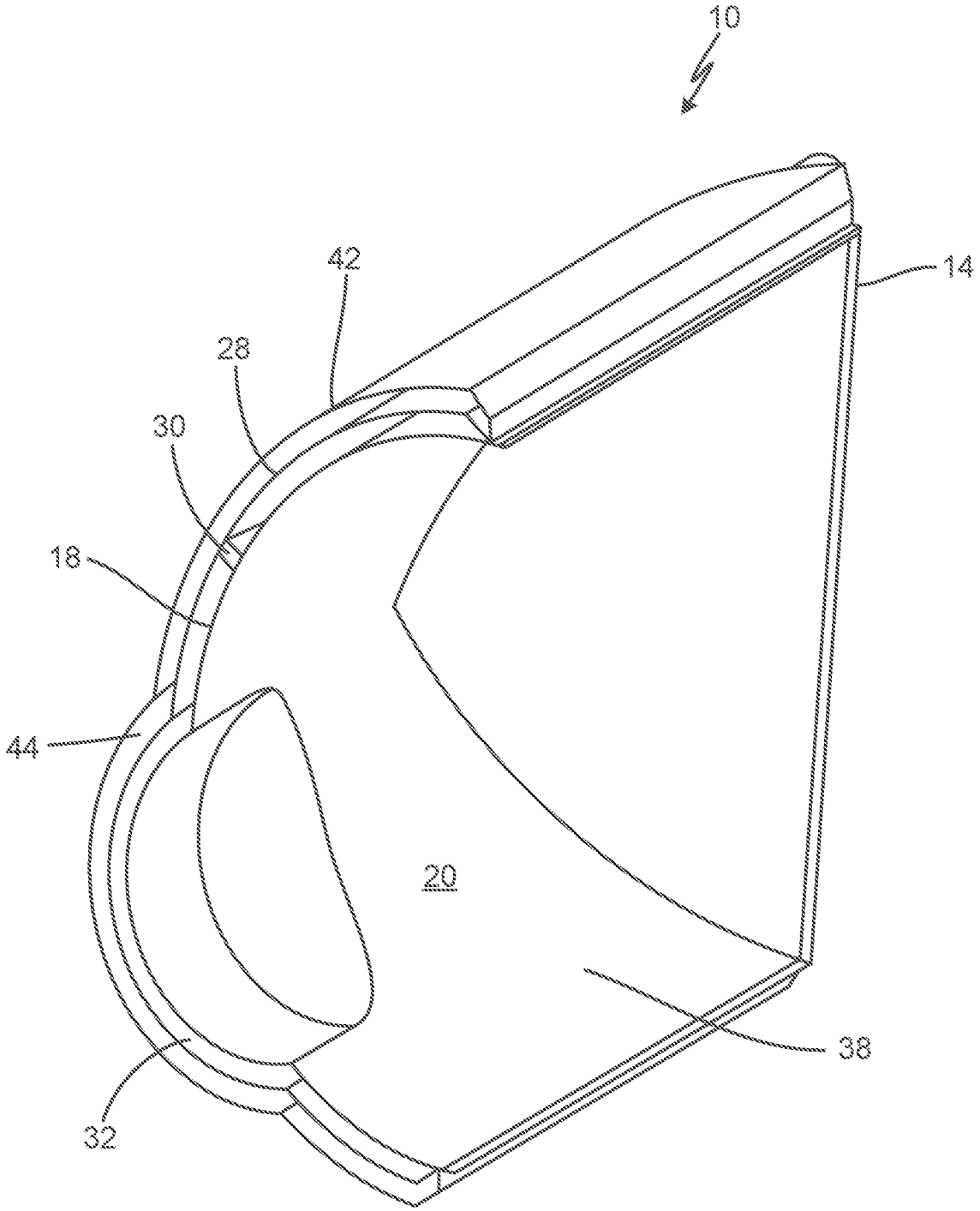
FIG. 4 is a cross-sectional view of another example of a header.

FIG. 4 is a cross-sectional view of an alternative example of header 10. As shown in FIG. 4, header 10 includes third wall 42 and insulating air gap 44. Third wall 42 attaches to second wall 28 opposite of first wall 18. Insulating air gap 44 is between third wall 42 and second wall 28. In the example shown in FIG. 3, Supports 40 extended from first wall 18 to second wall 28 within second passageway 26. In another example, supports 40 can also extend from second wall 28 to third wall 42 within insulating air gap 44. Inserting supports 40 into both second passageway 26 and insulating air gap 44 improves the stiffness of header 10 and provides support between first wall 18 and second wall 28 and second wall 28 and third wall 42.

Third wall 42 and insulating air gap 44 help protect header 10 by insulating header 10. Insulating air gap 44 is a sealed dead space filled with a gas that surrounds second wall 28 and insulates header 10 to minimize heat transfer from header 10 to the surrounding environment. The insulation provided by third wall 42 and insulating air gap 44 helps control the heating fluid temperature within heating channel 32 by reducing heat loss to the surrounding environment which may be at freezing temperatures. Additionally, the insulation provided by third wall 42 and insulating air gap 44 helps header 10 maintain the air temperature in first passageway 16 and plenum 38. Further, third wall 42 and insulating air gap 44 can hermetically seal header 10 so that header 10 can be used in a hazardous environment.

Header 10 can be formed from casting, additive manufacturing, or any other process capable of forming header 10. First wall 18, second wall 28, third wall 42, partitions 30, and supports 40 can each be made from titanium alloys, aluminum alloys, nickel-chromium based alloys, steel alloys, and/or any other material used to additively manufacture header 10 or cast header 10.

Figure 5A:
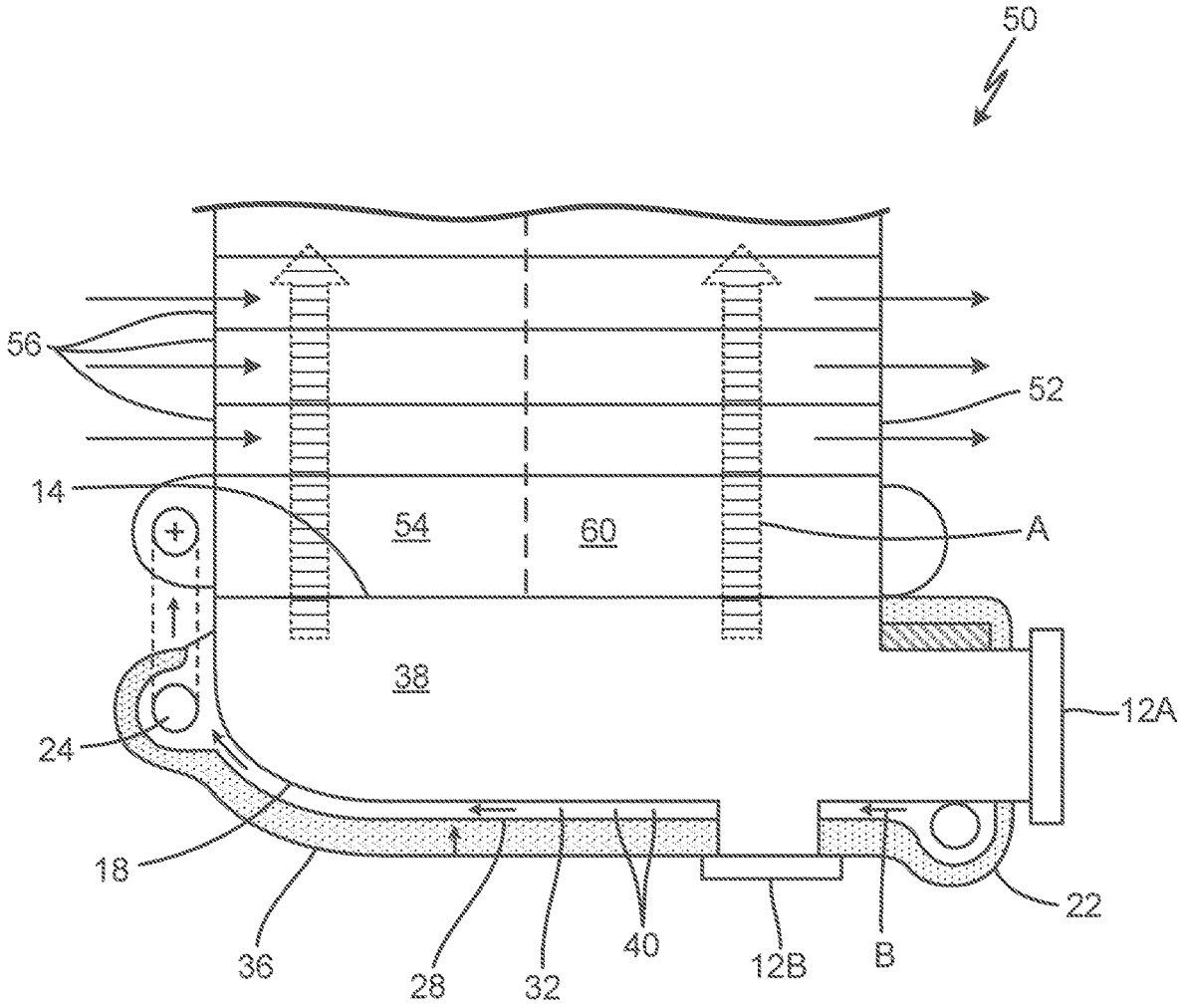
FIG. 5A is a schematic cross-sectional view of a header attached to a crossflow heat exchanger.
Figure 5B:
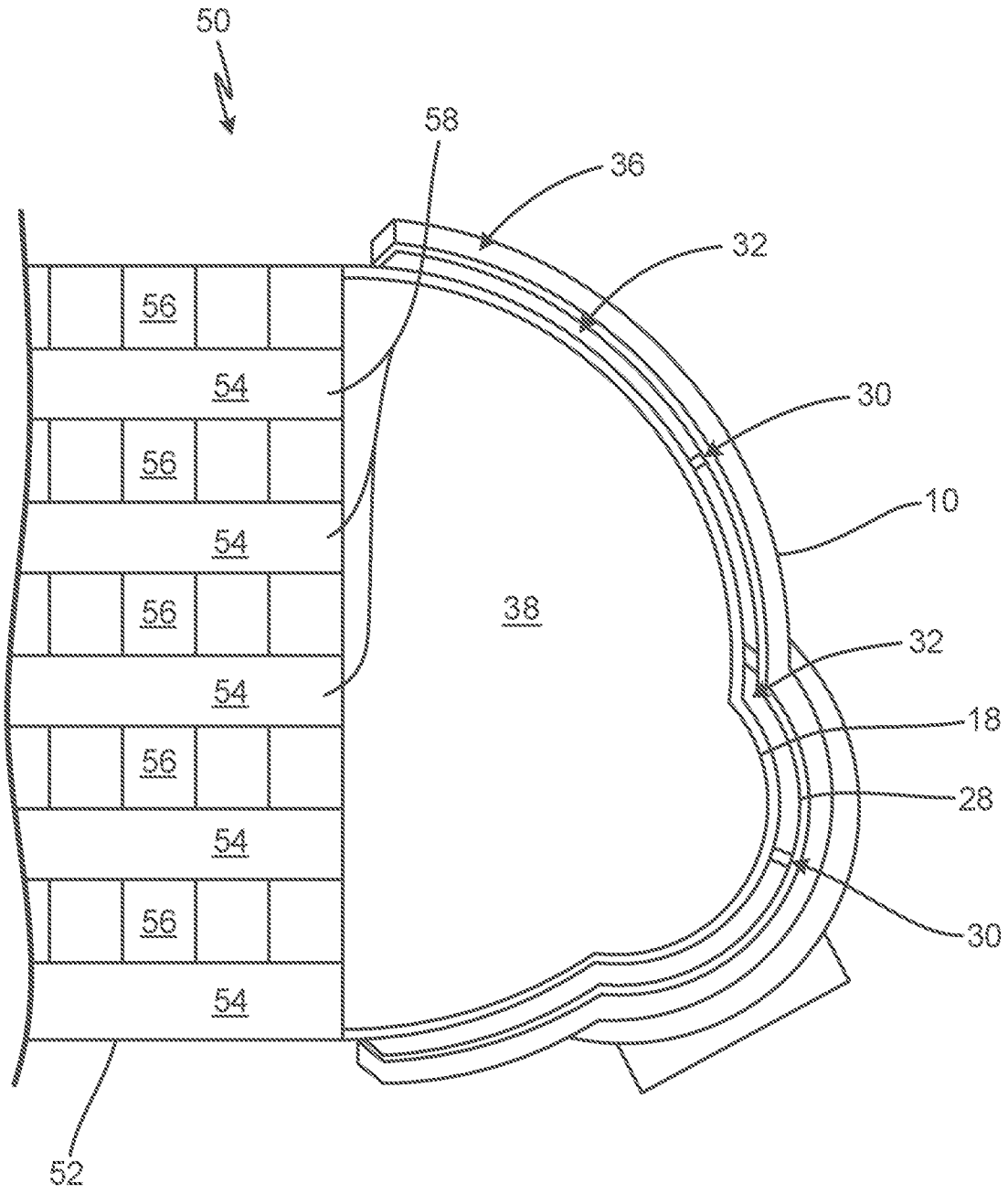
FIG. 5B is another schematic cross-sectional view of the header attached to a crossflow heat exchanger.

FIGS. 5A and 5B will be discussed concurrently. FIG. 5A is a schematic cross-sectional view of header 10 attached to a crossflow heat exchanger core (core) 52. FIG. 5B is another schematic cross-sectional view of header 10 attached to core 52.

As shown in FIGS. 5A and 5B, heat exchanger 50 includes header 10 and core 52. Core 52 includes at least one cold layer (cold layer) 54, at least one hot layer (hot layer) 56, cold layer inlets 58, and melt pass 60. Core 52 is a crossflow heat exchanger core with cold layer 54 extending perpendicular to hot layer 56. Airflow A enters header 10 through inlets 12 and plenum 38 turns airflow A towards first outlet 14. First outlet 14 covers all of cold layer inlets 58 so that airflow A exiting first outlet 14 enters cold layer inlets 58. Thus, first outlet 14 fluidically connects plenum 38 and cold layer inlets 58. Airflow A flows through cold layer 54 to cold layer outlet (not shown). Cold layer 54 and hot layer 56 are made from materials with a high thermal conductivity, e.g., titanium alloys, aluminum alloys, nickel-chromium based alloys, steel alloys, and/or any other material with a high thermal conductivity, to promote heat transfer therebetween.

Melt pass 60 is located near cold layer inlet 58 within core 52. Melt pass 60 helps prevent ice accretion within cold layer inlets 58 by heating cold layer inlets 58. As shown in FIGS. 5A and 5B, second outlet 24 of heating channel 32 can be connected to melt pass 60 to utilize the same heating fluid within both systems.

DISCUSSION OF POSSIBLE EMBODIMENTS

The following are non-exclusive descriptions of possible embodiments of the present invention.

In one example, a heat exchanger header includes a first inlet, a first passageway that fluidically connects the first inlet to a first outlet, a second inlet, and a second passageway. The second passageway fluidically connects the second inlet to a second outlet. The first inlet, the first passageway, and the first outlet are fluidically isolated from the second inlet, the second passageway, and the second outlet.

The heat exchanger header of the preceding paragraph can optionally include, additionally and/or alternatively, any one or more of the following features, configurations and/or additional components:

- further comprising: a first wall defining the first passageway; and a second wall attached to the first wall opposite the first passageway;
- wherein the second passageway is between the first wall and the second wall;
- wherein the first inlet extends through both the first wall and the second wall, and wherein the second inlet extends through only the second wall;
- wherein the second passageway comprises at least one partition extending from the first wall to the second wall, and wherein the at least one partition creates a channel within the second passageway that is configured to guide a flow from the second inlet to the second outlet;
- further comprising an insulation layer attached to the second wall opposite the first wall;
- wherein the channels comprise one or more fins;
- wherein the channels comprise one or more columns;
- further comprising: a first wall; a second wall attached to the first wall; a third wall attached to the second wall opposite the first wall, wherein: the first wall defines the first passageway, and wherein the first passageway comprises a plenum adjacent to the first outlet; the first wall and the second wall define the second passageway between the first wall and the second wall; and the second wall and the third wall define an insulating air gap between the second wall and the third wall;
- wherein the first inlet extends through the first wall, the second wall, and the third wall, and wherein the second inlet extends through the second wall and the third wall without extending through the first wall;
- wherein the second passageway comprises at least one partition extending from the first wall to the second wall, and wherein the at least one partition creates a channel within the second passageway that is configured to guide a flow from the second inlet to the second outlet;
- wherein at least one of the channels and the insulating air gap comprise one or more fins; and/or
- wherein the channels and/or the insulating air gap comprise one or more columns.

In another example, a heat exchanger header includes a body with an outer surface and an inner surface. The inner surface defines a plenum and a first outlet fluidically connected with the plenum. The heat exchanger header also includes a first inlet extending through the body and fluidically connected with the plenum. A heating fluid channel is formed in the body between the outer surface and the inner surface and extends from a second inlet to a second outlet. The heating fluid channel is fluidically isolated from the plenum, and an insulation layer covers the outer surface of the body.

The heat exchanger header of the preceding paragraph can optionally include, additionally and/or alternatively, any one or more of the following features, configurations and/or additional components:

- further comprising: a first wall defining the inner surface of the body, wherein the first wall fluidically isolates the plenum and the heating fluid channel; and a second wall attached to the first wall opposite the plenum, wherein the heating fluid channel is between the first wall and the second wall;
- further comprising a third wall, wherein the third wall defines the outer surface of the body, and wherein the third wall attaches to the second wall opposite the first wall defining an insulating air gap between the second wall and the third wall; and/or
- wherein the heating fluid channel comprises at least one partition that defines a path from the second inlet to the second outlet.

In another example, a heat exchanger includes a core with a first layer having at least one passageway that extends in a first direction from an inlet to an outlet. The core also includes a second layer contiguous with the first layer, the second layer having at least one passageway extending in a second direction. The heat exchanger also includes a header that includes a body with an outer surface and an inner surface. The inner surface defines a plenum and a first outlet that fluidically connects the plenum and the inlet of the first layer of the core. The header also includes a first inlet extending through the body and fluidically connected with the plenum. A heating fluid channel is formed in the body between the outer surface and the inner surface and extends from a second inlet to a second outlet. The heating fluid channel is fluidically isolated from the plenum. The header also includes an insulation layer covering the outer surface of the body.

The heat exchanger of the preceding paragraph can optionally include, additionally and/or alternatively, any one or more of the following features, configurations and/or additional components:

- wherein the header comprises: a first wall defining the inner surface of the body, wherein the first wall fluidically isolates the plenum and the heating fluid channel; and a second wall attached to the first wall opposite the plenum, wherein the heating fluid channel is between the first wall and the second wall; and/or
- wherein the core further comprises a melt pass, wherein the melt pass is fluidically connected to the outlet of the heating fluid channel.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger header comprising:

a first inlet configured to be fluidically connected to a cold air system of an aircraft;

a first wall defining a first passageway, wherein the first passageway fluidically connects the first inlet to a first outlet;

a second inlet configured to be fluidically connected to a heating fluid source; and a second wall attached to the first wall opposite the first passageway forming a second passageway between the first wall and the second wall;

wherein the second passageway that fluidically connects the second inlet to a second outlet, wherein the first inlet, the first passageway, and the first outlet are fluidically isolated from the second inlet, the second passageway, and the second outlet and the first inlet extends through both the first wall and the second wall, and wherein the second inlet extends through only the second wall;

wherein the second passageway further comprises at least one partition extending from the first wall to the second wall, wherein the at least one partition creates a channel within the second passageway that is configured to guide a flow of heating fluid from the second inlet to the second outlet when the heat exchanger header is in operation;

wherein the second passageway further comprises at least one support extending from the first wall to the second wall; and a third wall attached to the second wall;

wherein:

the first passageway comprises a plenum adjacent to the first outlet;

the third wall is opposite the first wall; and the second wall and the third wall define an insulating air gap between the second wall and the third wall and the insulating air gap comprises one or more fins.

2. The header of claim 1, further comprising an insulation layer attached to the second wall opposite the first wall.

3. The header of claim 2, wherein the at least one support comprises one or more fins.

4. The header of claim 3, wherein the at least one support comprises one or more columns.

5. The header of claim 1, wherein the first inlet extends through the third wall, and wherein the second inlet extends through the third wall without extending through the first wall.

6. The header of claim 1, wherein the insulating air gap comprise one or more columns.

7. The header of claim 1, wherein the second inlet is gravitationally lower that the second outlet.

8. The header of claim 7, wherein the second channel further comprises a bleeder plug at the highest elevation of the second channel, wherein the bleeder plug is configured to be open to release displaced air from the second channel when the header is in operation.

9. A heat exchanger header comprising:

a body with an outer surface and an inner surface, wherein the inner surface defines a plenum and a first outlet fluidically connected with the plenum;

a first inlet extending through the body and fluidically connected with the plenum and configured to be fluidically connected to a cold air system on an aircraft;

a heating fluid channel formed in the body between the outer surface and the inner surface and extending from a second inlet to a second outlet, wherein the heating fluid channel is fluidically isolated from the plenum and configured to be fluidically connected to a heating fluid source;

an insulation layer covering the outer surface of the body;

a first wall defining the inner surface of the body, wherein the first wall fluidically isolates the plenum and the heating fluid channel;

a second wall attached to the first wall opposite the plenum, wherein the heating fluid channel is between the first wall and the second wall; and a third wall, wherein the third wall defines the outer surface of the body, and wherein the third wall attaches to the second wall opposite the first wall defining an insulating air gap between the second wall and the third wall and the insulating air gap comprises one or more fins;

wherein the heating fluid channel comprises at least one partition that defines a path from the second inlet to the second outlet.

10. The header of claim 9, wherein the second inlet is gravitationally lower that the second outlet.

11. The header of claim 10, wherein the second channel further comprises a bleeder plug at the highest elevation of the second channel, wherein the bleeder plug is configured to be open to release displaced air from the second channel when the header is in operation.

12. The header of claim 9, wherein the second inlet is gravitationally lower that the second outlet.

13. The header of claim 12, wherein the second channel further comprises a bleeder plug at the highest elevation of the second channel, wherein the bleeder plug is configured to be open to release displaced air from the second channel when the header is in operation.

14. A heat exchanger comprising:

a core comprising:

a first layer comprising at least one passageway that extends in a first direction from an inlet to an outlet; and a second layer contiguous with the first layer comprising at least one passageway extending in a second direction; and a header comprising:

a body with an outer surface and an inner surface, wherein the inner surface defines a plenum and a first outlet that fluidically connects the plenum and the inlet of the first layer of the core;

a first inlet extending through the body and fluidically connected with the plenum and configured to be fluidically connected to a cold air system of an aircraft;

a heating fluid channel formed in the body between the outer surface and the inner surface and extending from a second inlet to a second outlet, wherein the heating fluid channel is fluidically isolated from the plenum and is configured to be fluidically connect to a heating fluid source; and an insulation layer covering the outer surface of the body;

wherein the header further comprises:

a first wall defining the inner surface of the body, wherein the first wall fluidically isolates the plenum and the heating fluid channel;

a second wall attached to the first wall opposite the plenum, wherein the heating fluid channel is between the first wall and the second wall; and a third wall, wherein the third wall defines the outer surface of the body, and wherein the third wall attaches to the second wall opposite the first wall defining an insulating air gap between the second wall and the third wall and the insulating air gap comprises one or more fins.

15. The heat exchanger of claim 14, wherein the core further comprises a melt pass, wherein the melt pass is fluidically connected to the outlet of the heating fluid channel.

16. The heat exchanger of claim 15, wherein the second inlet is gravitationally lower that the second outlet.

17. The heat exchanger of claim 16, wherein the second channel further comprises a bleeder plug at the highest elevation of the second channel, wherein the bleeder plug is configured to be open to release displaced air from the second channel when the header is in operation.

* * * * *